US011661825B2

(12) United States Patent
Al-Harbi et al.

(10) Patent No.: US 11,661,825 B2
(45) Date of Patent: May 30, 2023

(54) HYBRID STIMULATION TOOL AND RELATED METHODS

(71) Applicant: Saudi Arabian Oil Company, Dhahran (SA)

(72) Inventors: Bader Ghazi Al-Harbi, Dammam (SA); Sameeh Issa Batarseh, Dhahran (SA); Norah Abdullah Aljeaban, Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 235 days.

(21) Appl. No.: 16/891,539

(22) Filed: Jun. 3, 2020

(65) Prior Publication Data

US 2021/0381353 A1 Dec. 9, 2021

(51) Int. Cl.

| | |
|---|---|
| ***E21B 43/119*** | (2006.01) |
| ***E21B 43/27*** | (2006.01) |
| *E21B 43/24* | (2006.01) |
| *E21B 43/114* | (2006.01) |

(52) U.S. Cl.

CPC ..... *E21B 43/119* (2013.01); *E21B 43/27* (2020.05); *E21B 43/114* (2013.01); *E21B 43/2405* (2013.01)

(58) Field of Classification Search

CPC ..... E21B 43/119; E21B 43/27; E21B 43/114; E21B 43/2405

See application file for complete search history.

(56) References Cited

U.S. PATENT DOCUMENTS

| | | | | |
|---|---|---|---|---|
| 6,725,933 | B2 * | 4/2004 | Middaugh | C09K 8/74 166/309 |
| 6,755,262 | B2 | 6/2004 | Parker | |
| 6,880,646 | B2 * | 4/2005 | Batarseh | E21B 43/11 166/57 |
| 6,888,097 | B2 | 5/2005 | Batarseh | |
| 8,678,087 | B2 | 3/2014 | Schultz et al. | |
| 9,022,115 | B2 * | 5/2015 | Kleefisch | E21B 43/11 166/297 |
| 2005/0230107 | A1 | 10/2005 | McDaniel et al. | |
| 2012/0118568 | A1 | 5/2012 | Kleefisch et al. | |
| 2013/0098043 | A1 | 4/2013 | Surjaatmadja | |
| 2014/0345861 | A1 | 11/2014 | Stalder et al. | |
| 2015/0129203 | A1 | 5/2015 | Deutch et al. | |

(Continued)

FOREIGN PATENT DOCUMENTS

| | | |
|---|---|---|
| CN | 203081295 U | 7/2013 |
| CN | 203334954 U | 12/2013 |

(Continued)

OTHER PUBLICATIONS

International Search Report for PCT/IB2020/057539, 5 pages (dated Feb. 19, 2021).

(Continued)

*Primary Examiner* — D. Andrews

(74) *Attorney, Agent, or Firm* — Osha Bergman Watanabe & Burton LLP

(57) ABSTRACT

This application relates to systems and methods for stimulating hydrocarbon bearing rock formations using a downhole hybrid tool for discharging a fracturing solution to a wellbore in the formation and for delivering an output laser beams to the rock formation.

21 Claims, 8 Drawing Sheets

(56) References Cited

U.S. PATENT DOCUMENTS

| | | | | |
|---|---|---|---|---|
| 2015/0198022 | A1 | 7/2015 | Stanecki et al. | |
| 2018/0112468 | A1 | 4/2018 | Savage et al. | |
| 2019/0017358 | A1 | 1/2019 | Morse et al. | |
| 2020/0115962 | A1 | 4/2020 | Batarseh | |
| 2020/0392818 | A1* | 12/2020 | Batarseh | E21B 7/15 |

FOREIGN PATENT DOCUMENTS

| | | | |
|---|---|---|---|
| WO | WO-2020/102870 | A1 | 5/2020 |
| WO | WO-2021/245452 | A1 | 12/2021 |

OTHER PUBLICATIONS

Written Opinion for PCT/IB2020/057539, 9 pages (dated Feb. 19, 2021).

* cited by examiner

HYBRID STIMULATION TOOL AND RELATED METHODS

TECHNICAL FIELD

This application relates to tools and related systems and methods for stimulating hydrocarbon bearing formations.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melting to form in the tunnel. There is no control over the geometry and direction of the tunnels created by the shaped charges. There are limits on the penetration depth and diameter of the tunnels. There is a risk involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

SUMMARY

Conventional methods for drilling holes in a formation have been consistent in the use of mechanical force by rotating a bit. Problems with this method include damage to the formation, damage to the bit, and the difficulty to steer the drilling assembly with accuracy. Moreover, drilling through a hard formation has proven very difficult, slow, and expensive. However, the current state of the art in laser technology can be used to tackle these challenges. Generally, because a laser provides thermal input, it will break the bonds and cementation between particles and simply push them out of the way. Drilling through a hard formation will be easy and fast, in part, because the disclosed methods and systems will eliminate the need to pull out of the wellbore to replace the drill bit after wearing out and can go through any formation regardless of its compressive strength.

The present disclosure relates to tools and methods for drilling a hole(s) in a subsurface formation utilizing high power laser energy (for example, greater than 1 kW). In particular, various embodiments of the disclosed tools and methods use a hybrid tool of acid stimulation and high power laser(s) with the power conveyed via optical transmission media, such as fiber optic cables, down the wellbore to a downhole target via a laser tool. Generally, the tool described in this application can drill, perforate, and orient itself in any direction.

An example tool is for perforating a wellbore in a downhole environment within a rock formation. The tool includes a perforation unit disposed within an elongated body of the tool. The perforation unit includes a pipe transferring a fracturing solution. The pipe extends within the elongated body of the tool. The perforation unit includes a nozzle in fluid connection with the pipe. The nozzle is for discharging the fracturing solution to the wellbore and for controlling a flow of the fracturing solution. The tool includes a laser unit disposed within an elongated body of the tool. The laser unit includes an optical transmission media passing a raw laser beam generated from a laser generator. The optical transmission media extends within an elongated body of the tool. The laser unit includes a laser head coupled to the optical transmission media. The laser head receives the raw laser beam from the optical transmission media. The laser head includes an optical assembly controlling at least one characteristic of an output laser beam.

The optical transmission media and the pipe may be disposed coaxially relative to a longitudinal axis of the elongated body. The optical transmission media may be disposed within the pipe. The optical transmission media may include one or more casings thereon. The one or more casings may be configured to resist downhole pressure. The one or more casings may include an insulating casing for insulating the optical transmission media from the fracturing solution.

The fracturing solution may include an acid selected from the group consisting of hydrofluoric acid (HF), hydrochloric acid (HCl), hydrobromic acid (HBr), hydroiodic acid (HI), hypochlorous acid (HClO), chlorous acid (HClO2), chloric acid (HClO3), perchloric acid (HClO4), hypobromic acid (HBrO), bromous acid (HBrO2), chloric acid (HBrO3), perbromic acid (HBrO4), hypoiodous acid (HIO), iodous acid (HIO2), iodic acid (HIO3), periodic acid (HIO4), hypofluorous acid (HFO), sulfuric acid (H2SO4), fluorosulfuric acid (HSO3F), nitric acid (HNO3), phosphoric acid (H3PO4), fluoroantimonic acid (HSbF6), fluoroboric acid (HBF4), hexafluorophosphoric acid (HPF6), chromic acid (H2CrO4), boric acid (H3BO3), formic acid (HCOOH), acetic acid (CH3COOH), methanesulfonic acid (CH3SO3H), ethylenediaminetetraacetic acid (EDTA), glutamic diacetic acid (GLDA), and combinations thereof.

The rock formation may include sandstone and the fracturing solution may include HCl. The rock formation may include clay and the fracturing solution may include HF.

The perforation unit may include a plurality of the nozzles. The plurality of the nozzles may be spaced along a length of the elongated body. The plurality of the nozzles may be radially off-set at a regular angular interval. The regular angular interval may be about 15, 30, 45, 60, 90, 120, 135, 150, or 180 degrees.

The laser unit may include a purging assembly disposed at least partially within or adjacent to the laser head. The purging assembly may deliver a purging fluid to an area proximate the output laser beam. The purging assembly may include purging nozzles. At least a portion of the purging nozzles may be vacuum nozzles connected to a vacuum source. The purging nozzles may be for removing debris and/or gaseous fluids from the area proximate the output laser beam when vacuum is applied.

The laser unit may include an orientation nozzle disposed about an outer circumference of the laser head. The orientation nozzle may control motion and orientation of the laser head within the wellbore. The orientation nozzle may be a purging nozzle providing thrust to the laser head for movement within the wellbore. The orientation nozzle may be movably coupled to the laser head. This may allow the orientation nozzle to rotate or pivot relative to the laser head. The orientation nozzle may provide forward motion, reverse motion, rotational motion, or combinations thereof, to the laser head relative to the tool.

The tool may include a centralizer coupled to the tool. The centralizer may hold the tool in the wellbore. The tool may include a plurality of centralizers disposed on the elongated body. A first portion of the plurality of centralizers may be disposed forward of the perforation unit and a second portion of the plurality of centralizers may be disposed aft of the perforation unit.

An example tool is for perforating a wellbore in a downhole environment within a rock formation. The tool includes a perforation unit disposed within an elongated body of the tool. The perforation unit includes a pipe transferring a fracturing solution comprising acid. The pipe extends within the elongated body of the tool. The perforation unit includes a plurality of nozzles in fluid connection with the pipe. The plurality of nozzles are for discharging the fracturing solution to the wellbore and for controlling a flow of the fracturing solution. The tool includes a laser unit disposed within the elongated body of the tool. The laser unit includes an optical transmission media passing a raw laser beam generated from a laser generator. The optical transmission media extends within an elongated body of the tool. The laser unit includes a laser head coupled to the optical transmission media. The laser head receives the raw laser beam from the optical transmission media. The laser head includes an optical assembly controlling at least one characteristic of an output laser beam.

An example method uses a tool for perforating a wellbore. The method includes the step of positioning the tool within a wellbore within a rock formation. The tool includes a perforation unit disposed within an elongated body of the tool. The perforation unit includes a pipe transferring a fracturing solution. The pipe extends within the elongated body of the tool. The perforation unit includes a nozzle in fluid connection with the pipe. The nozzle is for discharging the fracturing solution to the wellbore and for controlling a flow of the fracturing solution. The tool includes a laser unit disposed within the elongated body of the tool. The laser unit includes an optical transmission media passing a raw laser beam generated from a laser generator. The optical transmission media extends within an elongated body of the tool. The laser unit includes a laser head coupled to the optical transmission media. The laser head receives the raw laser beam from the optical transmission media. The laser head includes an optical assembly controlling at least one characteristic of an output laser beam. The method includes delivering the output laser beams to the rock formation. The method includes discharging the fracturing solution to the rock formation.

DEFINITIONS

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

Circumference: As used herein, the term "circumference" refers to an outer boundary or perimeter of an object regardless of its shape, for example, whether it is round, oval, rectangular or combinations thereof.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

Figure 1:
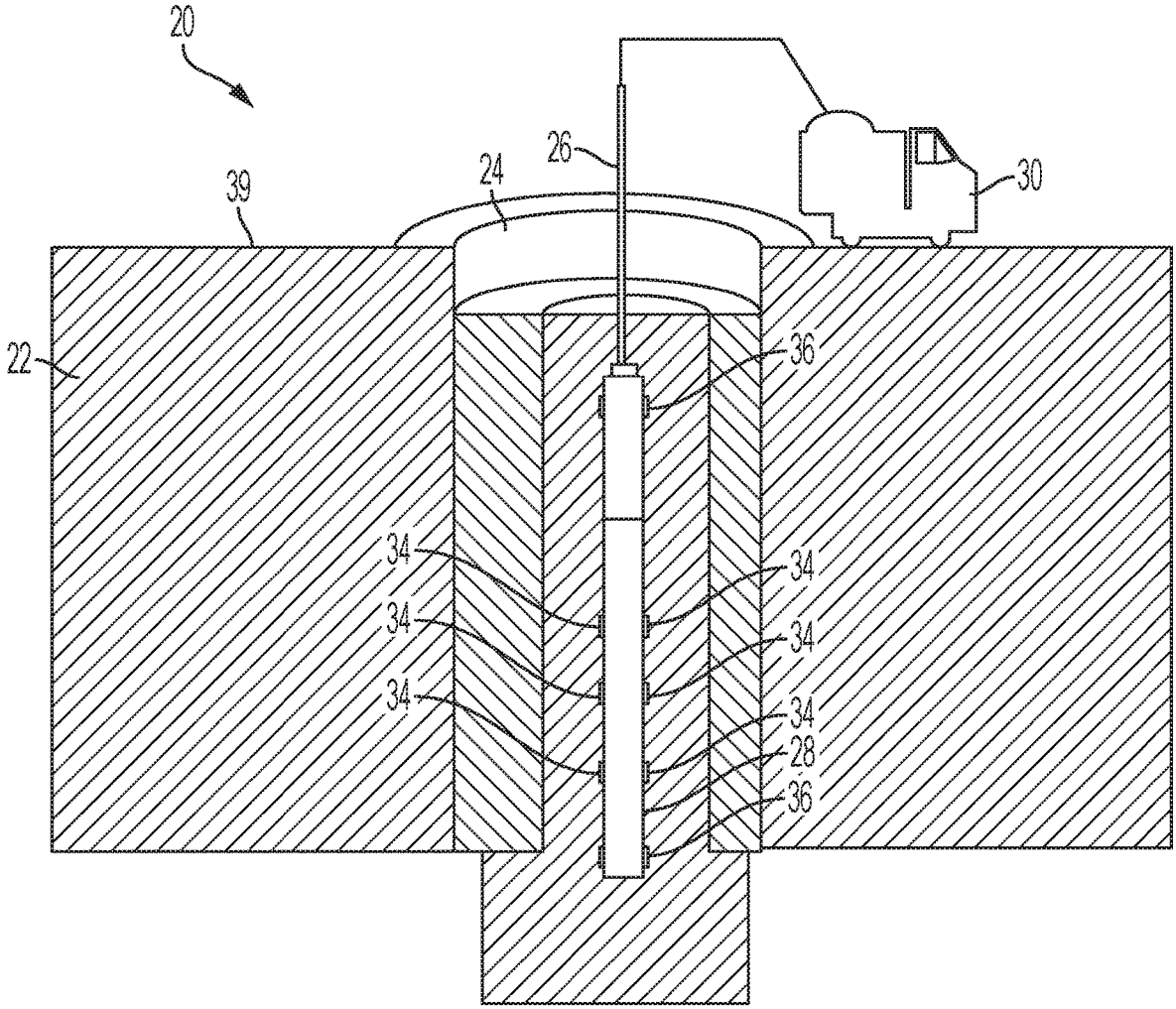
FIG. 1 is a schematic representation of a stimulation tool disposed within a wellbore in accordance with one or more embodiments.

FIG. 1 depicts a portion of a stimulation tool 20 that may be lowered downhole via any service provider using a coiled tube unit, wireline, or tractors as known in the art. The stimulation tool 20 includes a perforation unit and a laser unit (see FIG. 2). An elongated body 28 disposed in the stimulation tool houses a pipe of the perforation unit for a fracturing solution and an optical transmission media of the laser unit (see FIG. 2). The elongated body defines a series of exit ports 34 disposed about the circumference of the elongated body 28 to allow the fracturing solution to be deployed into a wellbore 24 of the formation 22. The stimulation tool 20 also includes centralizers 36 for holding the stimulation tool 20 in position within the wellbore 24 and to isolate a zone if needed to perform a specific task in that zone upon reaching a target.

The centralizers 36 can be disposed at various points along the elongated body 28 as need to suit a particular application. The centralizers 36 can also help support the weight of the stimulation tool 20 and can be spaced along the elongated body 28 as needed to accommodate the stimulation tool 20 extending deeper into the formation. The centralizers 36 may include an elastomeric material that expands when wet, bladders that inflate hydraulically or pneumatically from the ground, or by other mechanical means.

As further shown in FIG. 1, the stimulation tool 20 is coupled to a laser generator 30 and a fracturing solution tank (not shown) disposed on the ground 39 in a vicinity of the wellbore 24 via a cable 26 and a conduit (not shown), respectively. Cable 26 and the conduit may be integrated into a single tube or conduit. The cable 26 can include the optical transmission media (for example, fiber optics), along with any power or fluid lines as needed to operate the stimulation tool 20. The cable 26 extends from a laser generator 30 to optical transmission media (not shown) disposed within the elongated body 28. The conduit transfers the fracturing solution from the fracturing solution tank to the pipe within the elongated body 28.

Figure 2:
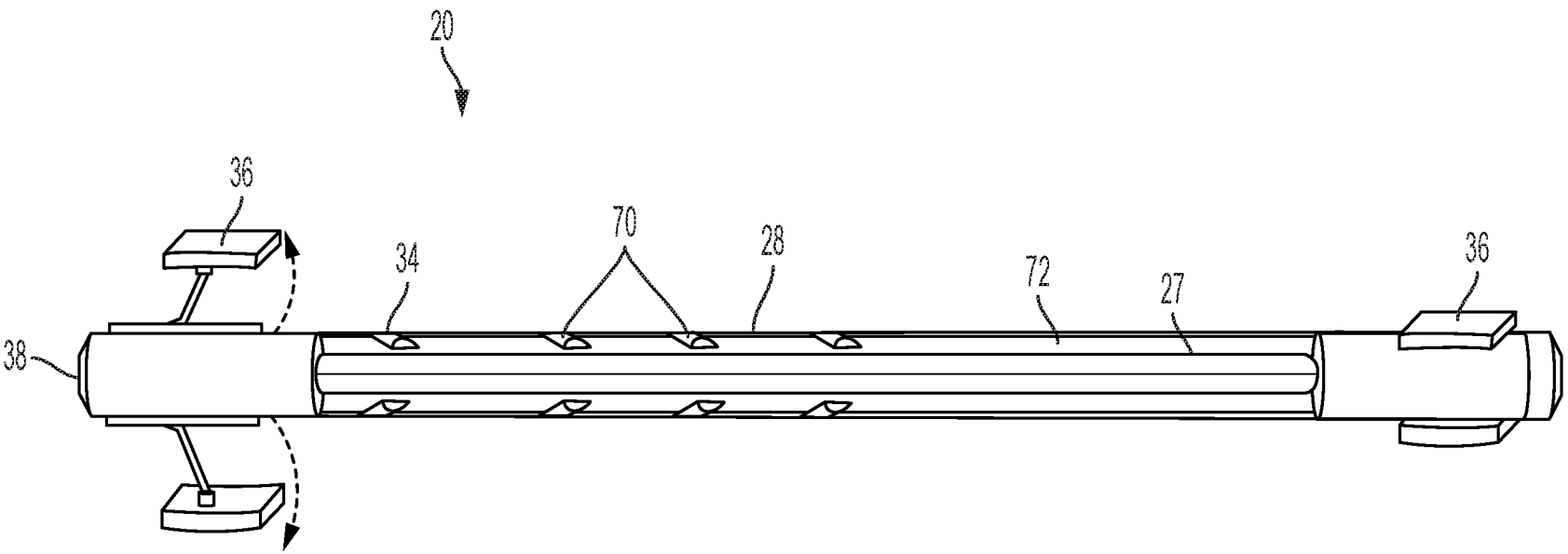
FIG. 2 is a schematic representation of the stimulation tool depicted in FIG. 1 in accordance with one or more embodiments.

FIG. 2 depicts one embodiment of the stimulation tool 20 in a partial cross-section. The stimulation tool 20 includes a perforation unit for supplying the fracturing solution, and a laser unit for applying high power laser energy in the wellbore. The elongated body 28 houses the pipe 72 of the perforation unit and the optical transmittal media 27 of the laser unit. In some embodiments, the pipe 72 and the optical transmission media 27 are disposed coaxially relative to a longitudinal axis of the elongated body 28. For example, the optical transmission media 27 may be disposed within the pipe 72. The optical transmittal media 27 may include casings to protect an optical fiber from the fracturing solution (see FIG. 4).

Figure 3:
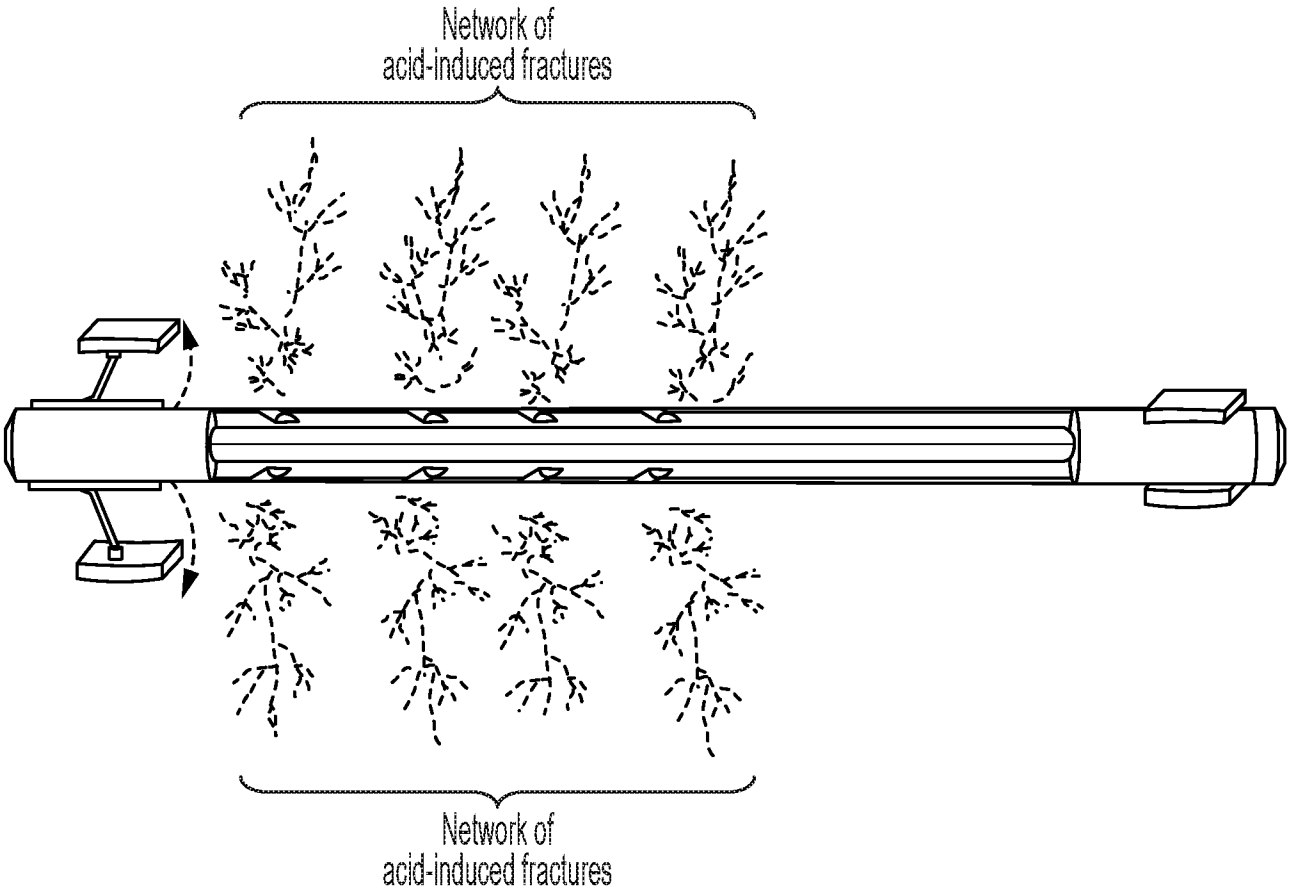
FIG. 3 is a schematic representation of creating a network of acid-induced fractures in the wellbore in accordance with one or more embodiments.

Nozzles 70 at the exit ports 34 are fluidly connected to the pipe 72, so that the nozzles 70 may discharge the fracturing solution received from the pipe 72. The stimulation tool 20 may generate a network of fractures, for example, acid-induced fractures, in the wellbore by injecting the fracturing solution as shown in FIG. 3. In some embodiments, the nozzles 70 may control flow rates, directions of the flow, and/or durations of the flow. The nozzles 70 may be controlled remotely, for example, at the ground 39. The exit ports 34 shown in FIG. 2 are disposed on diametrically opposed surfaces of a circumference of the elongated body 28; however, the exit ports 34 may be positioned anywhere along the tool body 28 to suit a particular application. For example, in some embodiments, the exit ports may be oriented in a spiral-like pattern where the exit ports 34 are spaced along a length of the elongated body 28 and radially off-set at regular angular intervals, for example, every 30 degrees, or at irregular intervals to suit a particular application.

In some embodiments, the stimulation tool 20 includes one, two, three, four, five, six, seven, eight, nine, ten, eleven, twelve, thirteen, fourteen, fifteen, sixteen, seventeen, eighteen, nineteen, or twenty nozzles 70. In some embodiments, the flow rate of each of the nozzles 70 may be substantially (for example, within about 1% of, within about 5% of, and/or within about 10% of) similar. In some embodiments, the flow duration of each of the nozzles 70 may be substantially (for example, within about 1% of, within about 5% of, and/or within about 10% of) similar. In some embodiments, each nozzle 70 may have different flow rate, direction and/or flow duration.

In some embodiments, the fracturing solution includes acid. The acid used with the technologies described may be selected from the group consisting of hydrofluoric acid (HF), hydrochloric acid (HCl), hydrobromic acid (HBr), hydroiodic acid (HI), hypochlorous acid (HClO), chlorous acid ($HClO_2$), chloric acid ($HClO_3$), perchloric acid ($HClO_4$), hypobromic acid (HBrO), bromous acid ($HBrO_2$), chloric acid ($HBrO_3$), perbromic acid ($HBrO_4$), hypoiodous acid (HIO), iodous acid ($HIO_2$), iodic acid ($HIO_3$), periodic acid ($HIO_4$), hypofluorous acid (HFO), sulfuric acid ($H_2SO_4$), fluorosulfuric acid ($HSO_3F$), nitric acid ($HNO_3$), phosphoric acid ($H_3PO_4$), fluoroantimonic acid ($HSbF_6$), fluoroboric acid ($HBF_4$), hexafluorophosphoric acid ($HPF_6$), chromic acid ($H_2CrO_4$), boric acid ($H_3BO_3$), formic acid (HCOOH), acetic acid ($CH_3COOH$), methanesulfonic acid ($CH_3SO_3H$), ethylenediaminetetraacetic acid (EDTA), glutamic diacetic acid (GLDA), and combinations thereof.

The acid may be selected depending on compositions of the rock formation. For example, if the rock formation includes sandstone, the fracturing solution may include HCl, organic acid (for example, formic acid (HCOOH), acetic acid ($CH_3COOH$), methanesulfonic acid ($CH_3SO_3H$)) and/or chelating agent (for example, ethylenediaminetetraacetic acid (EDTA), glutamic diacetic acid (GLDA)). An exemplary reaction is shown in the below chemical reaction Formula 1.

$$2HCl+CaCO_3 \rightarrow CaCl_2+H_2O+CO_2 \quad \text{Chemical Reaction Formula 1}$$

If the rock formation includes clay, the fracturing solution may include HF. An exemplary reaction is shown in the below chemical reaction Formula 2.

$$26HF+Al_2Si_4O_{10}(OH)_2+4HCl \rightarrow 4H_2SiF_6+2AlF_2{+}{+}\ 12H_2O+4Cl^- \quad \text{Chemical Reaction Formula 2}$$

In some embodiments, a flow rate of the fracturing solution is between 400 liters per minute (l/min) and 10,000 l/min. In some embodiments, for example, for acid fracturing, the volume of solution used may be between 230 $m^3$ and 320 $m^3$ (about 1,500-2,000 barrels (bbl)), and the solution flow rate may be between 3,000 l/min and 7,000 l/min (about 20-45 bbl/min). In some embodiments, for example, for matrix acidizing, the volume of solution used may be about 230 $m^3$ (about 1,500 bbl), and the flow rate may be between 4,70 l/min and 1,600 l/min (about 3-10 bbl/min).

In some embodiments, a molarity of the fracturing is within a range from about 1M to about 30M. In some embodiments, a molarity of the dissolving solution is within a range from about 1M to about 20M. In some embodiments, a molarity of the dissolving solution is within a range from about 1M to about 10M. In some embodiments, a morality of a dissolving solution is within a range of about 1M to about 5M. In some embodiments, a molarity of the dissolving solution is within a range from about 5M to about 30M. In some embodiments, a molarity of the dissolving solution is within a range from about 10M to about 30M. In some embodiments, a molarity of the dissolving solution is within a range from about 20M to about 30M.

Figure 4:
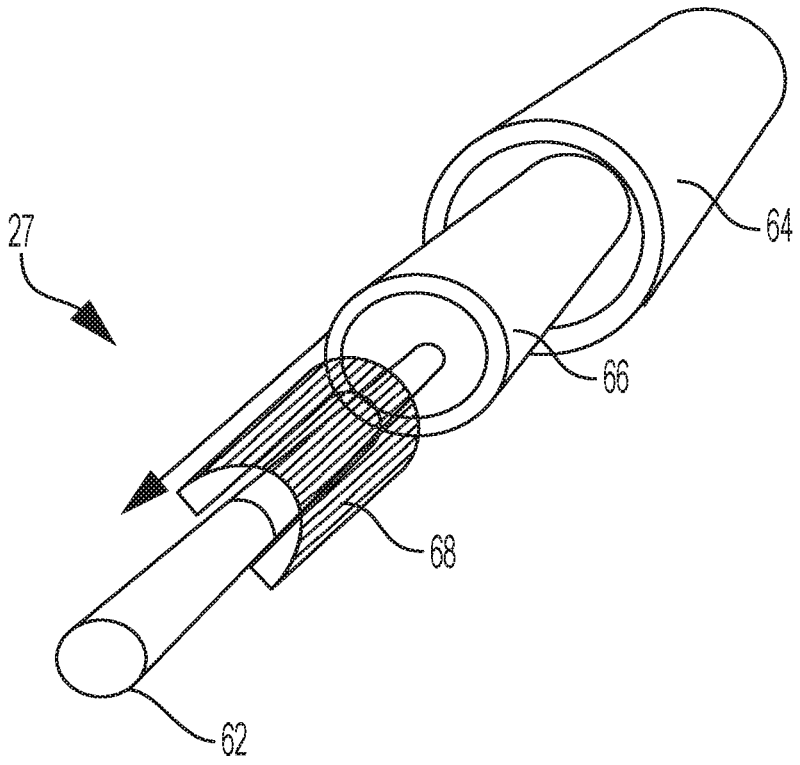
FIG. 4 is a partial, exploded perspective view of fiber optic cable for use in a tool in accordance with one or more embodiments.
Figure 5:
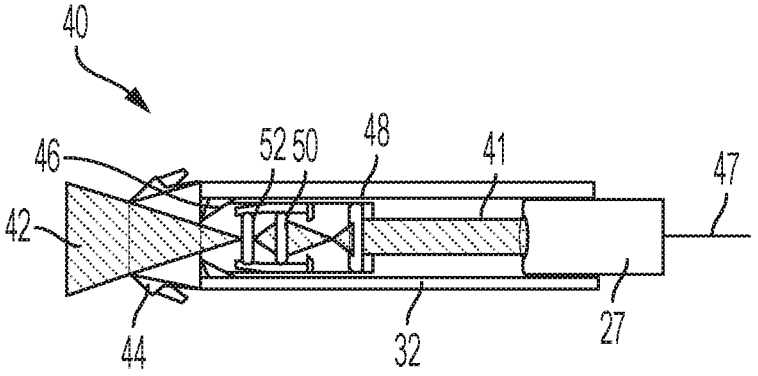
FIG. 5 is a schematic representation of a laser head for use with the stimulation tool of FIG. 2 in accordance with one or more embodiments.

The optical transmittal media 27 (or fiber optic cable) may be coupled with a laser head 38 (see FIG. 5). The energy from the laser generator 30 is transmitted to the stimulation tool 20, specifically via the optical transmittal media 27, which are shielded as shown in FIG. 4, to protect the optical transmittal media 27 from the fracturing solution. The optical transmittal media 27 may be bundled within the stimulation tool 20 in accordance with the same means as used for different materials/applications in the industry. The casing 64 houses the optical transmittal media 27. In some embodiments, the casings 64 may be aligned or secured within the pipe 72 by one or more jigs or other structure to hold the casing in position and guide its deployment.

FIG. 4 depicts one example of an internal configuration of the optical transmittal media 27 that can be shielded with a hard or flexible casing. In both types, the optical fiber 62 must be protected from high temperature, pressure, acid, and downhole conditions such as fluids, hydrogen gases, stress, vibration, etc. As shown, the optical transmittal media 27 includes an outer shield of a high temperature/pressure resistant and acid resistant casing 64, then a high temperature/pressure resistant insolation cable 66 to maintain a temperature of the fiber optics cable, as high temperature will damage the cable, then a protective cable 68, and then the optical fiber 62 to deliver the laser beam from the laser generator 30. In some embodiments, the outermost casing includes a material selected from a group of acid resistant material, for example, acid resistant metals. In some embodiments, the material is or includes steel, for example, carbon steel.

Referring back to FIG. 2, the stimulation tool 20 may be centralized by the centralizer pads 36, which may be inflated at a target position to assist that the stimulation tool 20 remains in the center of the wellbore and correctly aligned with the target. The stimulation tool 20 may also be equipped with logging and sensing implements to identify the target, for example, fiber optic cables, acoustic sensors, or sonic logging.

Figure 6:
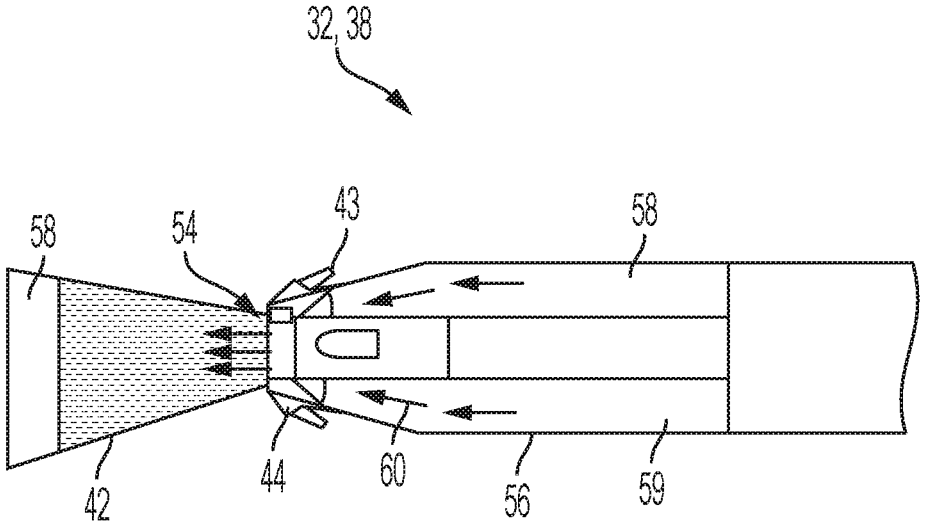
FIG. 6 is another schematic representation of the laser head of FIG. 5 in accordance with one or more embodiments.
Figure 7:
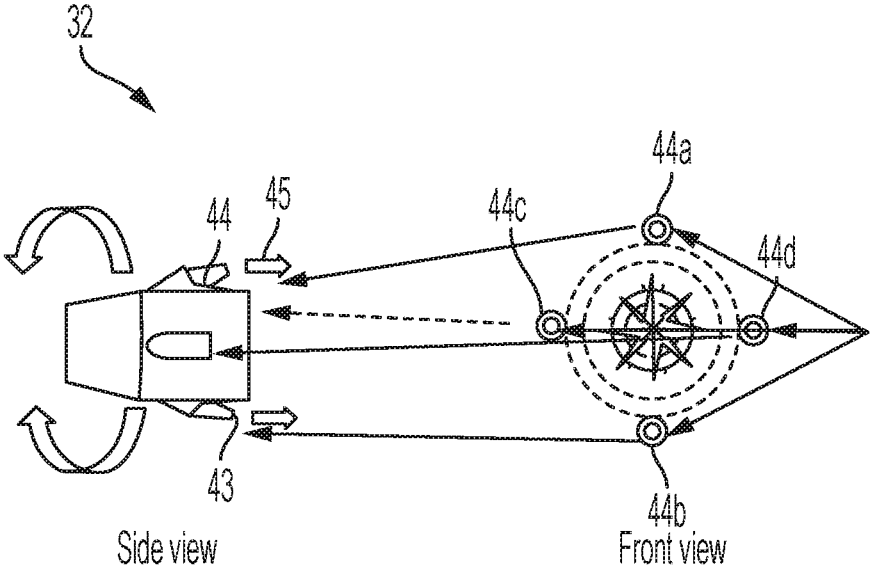
FIG. 7 is a schematic representation of a portion of the laser head of FIG. 5 in accordance with one or more embodiments.

The laser head 38 is depicted in detail in FIGS. 5-7. The laser head 38 is shown disposed at a distal end of the optical transmittal media 27 and houses an optical assembly 40. In some embodiments, the laser head 38 is a distal portion of the casing 64 in which the optical transmittal media 27 is secured. The laser head 38 may be coupled to the optical transmittal media 27 by any one of various mechanical means known in the art to provide the raw laser beam 41 to the optical assembly 40, which includes one or more lenses as necessary to condition the raw laser beam 41 to suit a particular application.

The optical assembly 40 shown in FIG. 5 includes a first lens 48, a second lens 50, and a cover lens 52. In operation, the raw laser beam 41 enters the laser head 38 and the optical assembly 40 via the first lens 48, which may focus the beam at a point, the beam may then defocus into the second lens 50, which may shape or collimate the beam as necessary to suit a particular application and the size and shape of the beam required. In various embodiments, a distance between the lenses 48, 50 may be adjusted to control the size of the beam. The beam exits the laser head 38 through the cover lens 52 as a shaped laser beam 42. The diameter of the beam 42 may vary depending on optical element used and application. In some embodiments, a beam 42 may have a diameter of between 0.25 and 3 inches (or about 0.6 cm and about 7.5 cm).

In addition, the laser head 38 may also include a plurality of orientation nozzles 44 and a plurality of purging nozzles 46. The purging nozzles 46 are disposed inside the head 38 for cooling the optical assembly and/or preventing any back-flow of debris into the head 38. Water or a hydrocarbon fluid, or generally any fluid or gas that is non-damaging and transparent to the laser beam, can be used to remove the debris. The purge fluid 58 can flow through channels 59 disposed within the laser head 38. In accordance with various embodiments, a portion of the purging nozzles 46 may be vacuum nozzles connected to a vacuum source and adapted to remove debris and gaseous fluids from around or within the laser head 38.

The orientation nozzles 44 may be located on an outer surface of the laser head 38. In the embodiment, there are four (4) orientation nozzles 44 shown disposed on and evenly spaced about an outer circumference of the laser head 38. A laser head 38 may be configured as deployable perforation unit 32. However, different quantities and arrangements of the orientation nozzles 44 are possible to suit a particular application. For example, if the orientation nozzles 44 are used to assist with deploying a perforation unit 32 from the elongated body 28, there may be additional orientation nozzles 44 disposed on the laser head 38.

Generally, the laser head 38 may be oriented by controlling a flow of a fluid (either liquid or gas) through the orientation nozzles 44. For example, by directing the flow of the fluid in a rearward direction 45 as shown in FIG. 7, the laser head 38 may be pushed forward in the wellbore by utilizing thrust action, where the openings 43 of the orientation nozzles 44 are facing the opposite directions of the laser head 38 and the fluid flows backward providing the thrust force moving the perforation unit 32 forward. Controlling the flow rate may control the speed of the perforation unit 32 within the wellbore. The fluid for providing the thrust may be supplied from the ground 39 and delivered by a fluid line included within the cable 26.

As shown in FIG. 7, there may be four (4) orientation nozzles 44*a*, 44*b*, 44*c*, 44*d* evenly spaced around the laser head 38. Each orientation nozzle 44 flows a fluid to allow to the laser head 38 to move and can be separately controlled. For example, if orientation nozzle 44*a* is the only orientation nozzle on, then the laser head 38 may turn in the south direction, the turn degree depends on the controlled flow rate from that orientation nozzle 44*a*. If all of the orientation nozzles 44 are evenly turned on, then the laser head 38 may move linearly forward or in reverse depending on the position of the orientation nozzles 44.

In various embodiments, the orientation nozzles 44 may be fixedly connected to the laser head 38 for limited motion control or be movably mounted to the laser head 38 for essentially unlimited motion control of the perforation unit 32. In one embodiment, the orientation nozzles 44 are movably mounted to the laser head 38 via servo motors with swivel joints that may control whether the openings 43 face rearward (forward motion), forward (reverse motion), or at an angle to a central axis 47 (rotational motion or a combination of linear and rotational motion depending on the angular displacement of the orientation nozzle 44 relative to the central axis 47). For example, if the orientation nozzles 44 are aligned perpendicular to the central axis 47, the orientation nozzles 44 may only provide rotational motion. If the orientation nozzles 44 are parallel to the central axis 47, then the orientation nozzles 44 may only provide linear motion. A combination of rotational and linear motion is provided for any other angular position relative to the central axis 47. The fluid lines for providing the thrust may be coupled to the nozzles via swivel couplings as known in the art.

FIG. 6 depicts a laser head 38 with additional features, such as fiber optic sensors 54 for temperature, pressure, or both; and acoustic sensing/logging fibers 56 to monitor the laser perforation tool 20 performance and collect formation information as logging.

The laser still requires one or more fluids, but these fluids are used to purge and clean the hole from the debris, opening up a path for the laser beam, and to orient the laser head 38. FIG. 6 depicts an internal configuration of the laser head 38 that is configured to have the purge fluid 58 merge with the laser beam 42. As shown in FIG. 6, the purge fluid 58 is merged with the laser beam 42, with the flow direction 60 running longitudinally through the channels 59 formed within the laser head 38.

In various embodiments, the stimulation tool 20 is introduced into the wellbore 24 via a coiled tubing unit that provides a reel, power and fluid for the tool, and host all of the laser supporting equipment. The laser source may be also coupled to the coiled tubing unit. The laser generator 30 is switched off while the laser perforation tool 20 is being inserted into the wellbore 24. Once the stimulation tool 20 reaches the target, typically an open hole, the centralizers 36 may inflate to centralize the tool at that location and the laser may turn on along with the source of purge fluid 58 for the purging nozzles 46 and orientation nozzles 44, if included.

In various embodiments, a diameter of the optical transmittal media 27, with shielding is within the range of one (1) inch (or about 2.5 cm) to five inches (or about 12.5 cm).

In some embodiments, the stimulation tool 20 has sensors to monitor and control the stimulation process. The first, second, third, and fourth sensors 66, 68, 70, 72 may include electronic transmitters, receivers, and/or transceivers, RFID tags and receivers, proximity sensors, strain gauges, Hall sensors, temperature probes, static pressure transmitters, differential pressure transmitters, moisture sensors, accelerometers, and other types of sensors.

Figure 8:
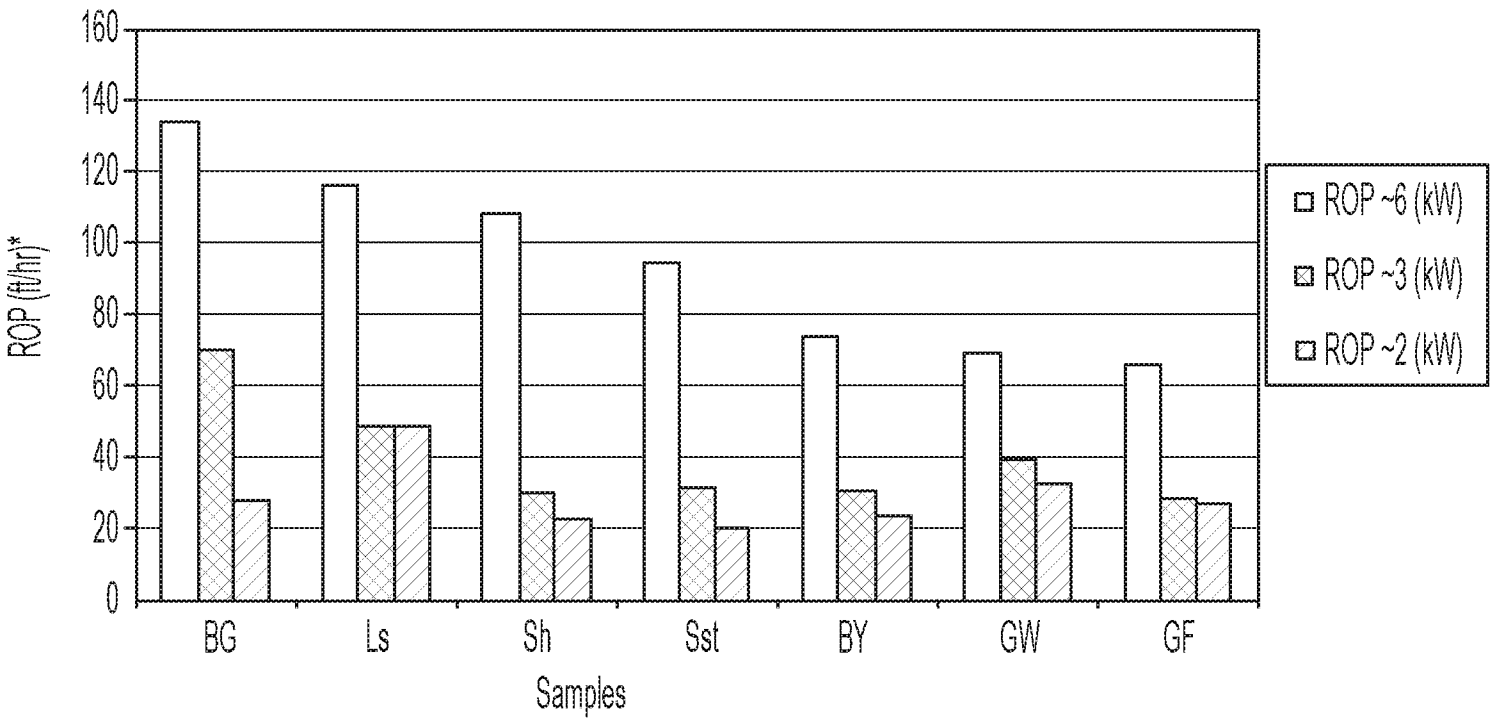
FIG. 8 is a graphical representation of the results of the use of a tool in accordance with one or more embodiments of the methods disclosed herein.

One advantage of using high power laser technology is the ability to create controlled non-damaged, clean holes for various types of the rock. The laser perforation tools disclosed herein have capability to penetrate in many types of rocks having various rock strengths and stress orientations, as shown in the graph of FIG. 8. The graph represents the Rate of Penetration (ROP) in feet per hour (ft/hr) for a variety of materials, where BG and BY=Brea Gray, Ls=limestone, Sh=shale, Sst=sandstone, and GW and GF=granite. The laser strengths used were at 2 kW, 3 kW, and 6 kW power.

In general, the construction materials of the stimulation tool 20 may be of materials that are resistant to the high temperatures, pressures, and vibrations that may be experienced within an existing wellbore, and that can protect the system from fluids, dust, and debris. One of ordinary skill in the art will be familiar with suitable materials.

The laser generator 30 may excite energy to a level greater than a sublimation point of the hydrocarbon bearing formation, which is output as the raw laser beam. The excitation energy of the raw laser beam required to sublimate the hydrocarbon bearing formation can be determined by one of skill in the art. In some embodiments, the laser generator 30 may be tuned to excite energy to different levels as required for different hydrocarbon bearing formations. The hydrocarbon bearing formation may include limestone, shale, sandstone, or other rock types common in hydrocarbon bearing formations. The discharged laser beam may penetrate a wellbore casing, cement, and hydrocarbon bearing formation to form, for example, holes or tunnels.

The laser generator 30 may be of laser unit capable of generating high power laser beams, which may be conducted through an optical transmittal media 27, such as, for example, lasers of ytterbium, erbium, neodymium, dysprosium, praseodymium, and thulium ions. In some embodiments, the laser generator 30 includes, for example, a 5.34-kW Ytterbium-doped multi-clad fiber laser. In some embodiments, the laser generator 30 may be of laser capable of delivering a laser at a minimum loss. The wavelength of the laser generator 30 may be determined by one of skill in the art as necessary to penetrate hydrocarbon bearing formations.

At least part of the stimulation tool 20 and its various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

Figure 9:
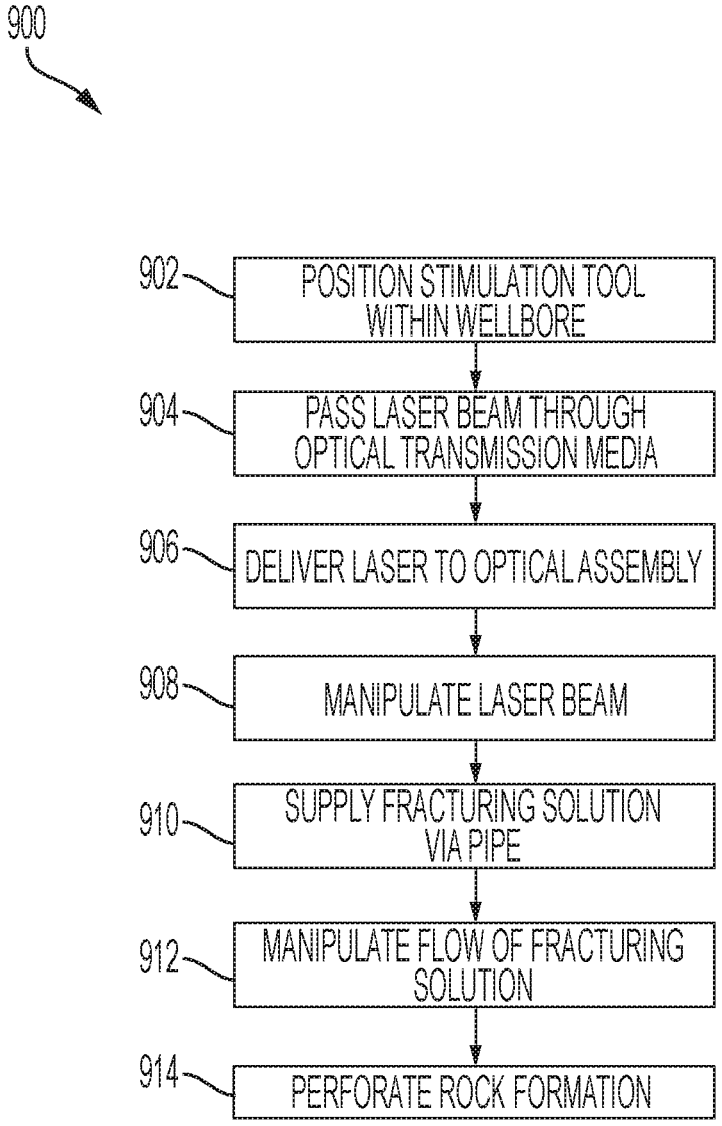
FIG. 9 illustrates a schematic of a method, according to aspects of the present disclosed embodiments.

FIG. 9 illustrates a method 900 of stimulating flow of hydrocarbons from a rock formation, using a stimulation tool 20 with the perforation unit and the laser unit. At step 902, the method 900 may include deploying the stimulation tool 20 including the perforation unit and the laser unit at or near the wellhead or surface of the borehole. At step 902, the method 900 may include positioning the stimulation tool 20 within the wellbore 24. At step 904, the method 900 may include passing laser beams generated from the laser generator 30 through the optical transmission media. At step 906, the method 900 may include delivering the laser beams to optical assemblies 40 in order to shape or collimate the laser beams as necessary (step 908). At step 910, the method 900 may include supplying the fracturing solution to the perforation unit via the pipe 72. At step 912, the method 900 may include manipulating the flow of the fracturing solution at the nozzles 70. At step 914, the method 900 may include perforating the rock formation via the laser beams and/or the fracturing solution.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain actions is immaterial, so long as the described method remains operable. Moreover, two or more steps or actions may be conducted simultaneously.

What is claimed is:

1. A tool for perforating a wellbore in a downhole environment within a rock formation, the tool comprising:

a perforation unit disposed within an elongated body of the tool, the perforation unit comprising:

a pipe transferring a fracturing solution, wherein the pipe extends within the elongated body of the tool; and a nozzle in fluid connection with the pipe, the nozzle for discharging the fracturing solution to the wellbore and for controlling a flow of the fracturing solution, and a laser unit disposed within an elongated body of the tool, the laser unit comprising:

an optical transmission media disposed within the pipe and passing a raw laser beam generated from a laser generator, wherein the optical transmission media extends within an elongated body of the tool, and wherein the optical transmission media and the pipe are disposed coaxially relative to a longitudinal axis of the elongated body; and a laser head coupled to the optical transmission media, the laser head receiving the raw laser beam from the optical transmission media, wherein the laser head comprises an optical assembly controlling at least one characteristic of an output laser beam.

2. The tool of claim 1, wherein the optical transmission media comprises one or more casings thereon.

3. The tool of claim 2, wherein the one or more casings are configured to resist downhole pressure.

4. The tool of claim 2, wherein the one or more casings comprise an insulating casing for insulating the optical transmission media from the fracturing solution.

5. The tool of claim 1, wherein the fracturing solution comprises an acid selected from the group consisting of hydrofluoric acid (HF), hydrochloric acid (HCl), hydrobromic acid (HBr), hydroiodic acid (HI), hypochlorous acid (HClO), chlorous acid ($HClO_2$), chloric acid ($HClO_3$), perchloric acid ($HClO_4$), hypobromic acid (HBrO), bromous acid ($HBrO_2$), chloric acid ($HBrO_3$), perbromic acid ($HBrO_4$), hypoiodous acid (HIO), iodous acid ($HIO_2$), iodic acid ($HIO_3$), periodic acid ($HIO_4$), hypofluorous acid (HFO), sulfuric acid ($H_2SO_4$), fluorosulfuric acid ($HSO_3F$), nitric acid ($HNO_3$), phosphoric acid ($H_3PO_4$), fluoroantimonic acid ($HSbF_6$), fluoroboric acid ($HBF_4$), hexafluorophosphoric acid ($HPF_6$), chromic acid ($H_2CrO_4$), boric acid ($H_3BO_3$), formic acid (HCOOH), acetic acid ($CH_3COOH$), methanesulfonic acid ($CH_3SO_3H$), ethylenediaminetetraacetic acid (EDTA), glutamic diacetic acid (GLDA), and combinations thereof.

6. The tool of claim 1, wherein the rock formation comprises sandstone and the fracturing solution comprises HCl.

7. The tool of claim 1, wherein the rock formation comprises clay and the fracturing solution comprises HF.

8. The tool of claim 1, wherein the perforation unit comprises a plurality of the nozzles.

9. The tool of claim 8, wherein the plurality of the nozzles are spaced along a length of the elongated body.

10. The tool of claim 8, wherein the plurality of the nozzles are radially off-set at a regular angular interval.

11. The tool of claim 10, wherein the regular angular interval is about 15, 30, 45, 60, 90, 120, 135, 150, or 180 degrees.

12. The tool of claim 1, wherein the laser unit comprises a purging assembly disposed at least partially within or adjacent to the laser head, wherein the purging assembly delivers a purging fluid to an area proximate the output laser beam.

13. The tool of claim 12, wherein the purging assembly comprises purging nozzles, at least a portion of the purging nozzles being vacuum nozzles connected to a vacuum source, and the purging nozzles for removing debris and/or gaseous fluids from the area proximate the output laser beam when vacuum is applied.

14. The tool of claim 1, the laser unit further comprises an orientation nozzle disposed about an outer circumference of the laser head, wherein the orientation nozzle controls motion and orientation of the laser head within the wellbore.

15. The tool of claim 14, wherein the orientation nozzle is a purging nozzle providing thrust to the laser head for movement within the wellbore.

16. The tool of claim 14, wherein the orientation nozzle is movably coupled to the laser head thereby allowing the orientation nozzle to rotate or pivot relative to the laser head, and the orientation nozzle provides forward motion, reverse motion, rotational motion, or combinations thereof to the laser head relative to the tool.

17. The tool of claim 1, further comprising a centralizer coupled to the tool, wherein the centralizer holds the tool in the wellbore.

18. The tool of claim 1, wherein the tool comprises a plurality of centralizers disposed on the elongated body, and a first portion of the plurality of centralizers is disposed forward of the perforation unit and a second portion of the plurality of centralizers is disposed aft of the perforation unit.

19. The tool of claim 1, wherein the nozzle is configured to direct the fracturing liquid into one or more perforations in the rock formation formed by the output laser beam so as to create a network of fractures in the wellbore.

20. A tool for perforating a wellbore in a downhole environment within a rock formation, the tool comprising:

a perforation unit disposed within an elongated body of the tool, the perforation unit comprising:

a pipe transferring a fracturing solution comprising acid, wherein the pipe extends within the elongated body of the tool; and a plurality of nozzles in fluid connection with the pipe, the plurality of nozzles for discharging the fracturing solution to the wellbore and for controlling a flow of the fracturing solution, and a laser unit disposed within the elongated body of the tool, the laser unit comprising:

an optical transmission media disposed within the pipe and passing a raw laser beam generated from a laser generator, wherein the optical transmission media extends within an elongated body of the tool, and wherein the optical transmission media and the pipe are disposed coaxially relative to a longitudinal axis of the elongated body; and a laser head coupled to the optical transmission media, the laser head receiving the raw laser beam from the optical transmission media, wherein the laser head comprises an optical assembly controlling at least one characteristic of an output laser beam.

21. A method of using a tool for perforating a wellbore, the method comprises steps of:

positioning the tool within a wellbore within a rock formation, the tool comprising:

a perforation unit disposed within an elongated body of the tool, the perforation unit comprising:

a pipe transferring a fracturing solution, wherein the pipe extends within the elongated body of the tool; and a nozzle in fluid connection with the pipe, the nozzle for discharging the fracturing solution to the wellbore and for controlling a flow of the fracturing solution;

a laser unit disposed within the elongated body of the tool, the laser unit comprising:

an optical transmission media disposed within the pipe and passing a raw laser beam generated from a laser generator, wherein the optical transmission media extends within an elongated body of the tool, and wherein the optical transmission media and the pipe are disposed coaxially relative to a longitudinal axis of the elongated body; and a laser head coupled to the optical transmission media, the laser head receiving the raw laser beam from the optical transmission media, wherein the laser head comprises an optical assembly controlling at least one characteristic of an output laser beam, selecting the fracturing solution based on composition of the rock formation;

delivering the output laser beams to the rock formation; and discharging the fracturing solution to the rock formation.

* * * * *